US005984232A

United States Patent [19]

Delorio, Jr.

[11] Patent Number: 5,984,232

[45] Date of Patent: Nov. 16, 1999

[54] FLEXIBLE SHAFT DRIVEN ROTARY CONTROL VALVE

[76] Inventor: Ralph Delorio, Jr., 13420 Meadow Rd., Everett, Wash. 98208-6838

[21] Appl. No.: 08/719,230

[22] Filed: Sep. 25, 1996

[51] Int. Cl.[6] ..... A63H 27/00

[52] U.S. Cl. ..... 244/75 R; 244/190; 446/34; 123/399

[58] Field of Search ..... 244/190, 59, 75 R; 251/294, 304; 701/2; 464/56; 446/56–58, 33–37; 123/399; 74/500.5

[56] References Cited

U.S. PATENT DOCUMENTS

| | | | |
|---|---|---|---|
| 1,260,571 | 3/1918 | Peck | 251/294 |
| 1,368,474 | 2/1921 | Berkman | 251/294 |
| 1,625,281 | 4/1927 | Raqué et al. | 74/500.5 |
| 3,002,506 | 10/1961 | Macorski | 123/73 |
| 3,049,110 | 8/1962 | Kerr | 123/102 |
| 3,201,648 | 8/1965 | Kerr | 317/5 |
| 3,355,964 | 12/1967 | Day | 251/294 |
| 3,784,174 | 1/1974 | Tarnofsky | 244/190 |
| 3,800,755 | 4/1974 | Klaiber et al. | 123/102 |
| 4,183,341 | 1/1980 | Eastman | 123/179 A |
| 4,532,901 | 8/1985 | Sturdy | 123/333 |
| 4,911,259 | 3/1990 | Dogahara et al. | 180/170 |
| 5,046,979 | 9/1991 | Ragan et al. | 244/54 |
| 5,072,708 | 12/1991 | Leiberoth-Leden et al. | 123/399 |
| 5,078,638 | 1/1992 | Molina | 244/54 |
| 5,345,907 | 9/1994 | Matsuoka | 123/399 |
| 5,433,181 | 7/1995 | Suzuki | 123/399 |
| 5,456,231 | 10/1995 | Suzuki et al. | 123/399 |

*Primary Examiner*—Galen L. Barefoot
*Attorney, Agent, or Firm*—Patrick M. Dwyer

[57] ABSTRACT

Apparatus and method for remote rotational control of various equipment control members and surfaces by means of a coaxially disposed flexible shaft, such as a torsion-cable, and housing or tube combination. One particular application of the invention is the remote, servo-activated rotational control of throttles for radio-controlled aircraft. In radio-controlled aircraft applications, rotational activation of the servo output shaft causes the relatively smaller twist or torsion cable, and therefore the throttle plate, to rotate and thereby to adjust the flow of fuel and air mixture through the carburetor and into the engine.

4 Claims, 3 Drawing Sheets

FLEXIBLE SHAFT DRIVEN ROTARY CONTROL VALVE

TECHNICAL FIELD

The invention relates to the field of controls and particularly to rotary mechanical control of valves and other moving control parts; more particularly, it relates to method and apparatus for a flexible shaft driven rotary control valve.

BACKGROUND OF THE INVENTION

The manufacture, supply, and servicing of radio-controlled (R/C) aircraft is estimated to be a multi-million dollar industry in the United States. Itadio transmitters and radio control technology have developed as might be expected in an age of rapid electronic technological growth, yet conventional bellcrank and pushrod linkages are still universally employed in the actuation of R/C engine throttles and other control surfaces. The use of such linkages is well known to result in intermittent and unpredictable binding of controls, leading to partial or total loss of control of the aircraft. They also usually result in loss of range of motion or in lost motion in the controls, leading to lack or loss of precision in control and in lack of precise handling. These same conventional linkages also result in slow and laborious processes for the disconnection, and particularly in reconnection (and necessarily finicky and painstaking readjustment of the linkages) of engines which must be removed for maintenance or repair. Similar problems are encountered in the control of throttles on gasoline-powered lawn mowers and other lawn and garden equipment (the market for which is estimated to equal or exceed that of R/C aircraft) and the like. What is needed is a remote control throttle, and in particular a control linkage, which overcomes these difficulties.

Rotary cables are known for providing power and motion transmission in general, such as for motor governors, and speedometers; however these systems are not known for use in control applications, where torsional stress can be more critical. Power transmission usage of such cables is typically one directional (or if bidirectional, it is still generally continuous and only alternately changes direction). In these conventional applications, strain in the rotary cable is "wound up" or taken up essentially only once for each duty cycle, especially if the rotational speed during the cycle does not vary much.

But in control applications, both speed (or lack thereof, as in no motion at all) and direction of rotation are varied constantly, and the sensitivity and precision losses due to strain wind up or take up can be huge in cables otherwise acceptable in power or motion transmission. A rotary cable for a control system then must partake of the qualities of a flexible shaft, having in particular a substantial torsional strain resistance.

Other proposed control systems cannot endure physical displacement, especially lateral displacement, without changing and affecting the control settings. For example, in a push pull (cable) connection, moving or bending the slack cable or coax has a direct and immediate impact on the control surface to which it is attached. The same is substantially true for bellcrank and pushrod systems.

DISCLOSURE OF THE INVENTION

Accordingly, it is an object of the invention to provide a remote control throttle resistant if not immune to control binding, having insignificant loss of range of motion and no lost motion in the controls, and which facilitates ready disconnection and reconnection of engines which must be removed for maintenance or repair.

It is a further object of the invention to provide a control linkage resistant if not immune to control binding, having insignificant loss of range of motion and no lost motion in the controls, and which facilitates ready disconnection and reconnection of engines which must be removed for maintenance or repair.

It is another object of the invention to provide a control linkage that can abide physical displacement, especially lateral displacement, without changing and affecting the control settings.

It is yet another object of the invention to meet any or all of the needs summarized above.

These and such other objects of the invention as will become evident from the disclosure below are met by the invention disclosed herein.

The invention addresses and provides such a system. The invention represents the first and only system for remote aircraft throttle control that can facilitate removal and replacement of an engine, with full range of control restored at the same level of precision as previously adjusted, and all in a matter of minutes. It also provides simple and relatively quick setting and adjustment of remote control settings to go from full throttle to full cut off reliably and repeatably.

The invention presents in one aspect a rotary control apparatus, such as a rotary control valve, like the throttle mechanism of a carburetor, having a control linkage, the linkage comprising a flexible shaft, the shaft operably connected to a rotatable control member, such as the throttle plate shaft, of the control apparatus for preferably intermittent co-rotation of the shaft and control member. In an alternate aspect it presents a control linkage for a rotary control apparatus, the linkage comprising a flexible shaft, the shaft operably connected to a rotatable control member of the control apparatus for co-rotation of the shaft and member. The flexible shaft is preferably a twistable flexible shaft (taht is, it is twistable within its flexure, the torsion not tending appreciably to straighten or recurve the shaft) and has a housing, with the housing operably restrained to resist twisting. The housing itself is also preferably flexible, and the shaft and housing are preferably coaxial to one another, and may be employed in the form of a coaxial cable.

The control member to which the flexible shaft is attached may also advantageously be a carburetor choke plate shaft, or the shaft of some aircraft control surface, such as an elevator or aileron control horn shaft. In the latter employment, it will generally not be necessary that the flexible shaft be coaxial with the control horn shaft, but may advantageously be connected to the control horn near the shaft so that rotation of the flexible shaft will impart a moment of torque to the horn, as will be appreciated by those skilled in the art, and thereby effect some rotational input to the control surface without the need for pushrods, bellcranks, and the like, and all the difficulties attendant on their use as discussed above. The flexible shaft is preferably motor driven, such as by a conventional servomotor, which may advantageously be disposed remotely from the control valve or control surface. In preferred applications, it is not necessary for the servomotor output shaft and the axis of rotation of the control member to be in line. Preferred motors are radio controlled (R/C).

In alternate embodiments of the invention, the control member may be a throttle or choke plate shaft or fuel injection throttle plate shaft, and the invention may advantageously be employed on garden and lawn equipment such as lawn mowers and the like, or on sports vehicles such as snowmobiles, and in place of a motor drive for the flexible shaft, a simple lever or wheel is employed at a location on the equipment remote from the control member, such as on a handle or frame of the equipment, to impart precise rotary control motion to the shaft and thus to the control member.

In another aspect, a radio controlled (R/C) aircraft throttle is presented with an aircraft throttle valve modified to receive and engage a first shaft connector attached to the throttle shaft of the valve, and with a radio controlled servo motor modified to receive and engage a second shaft connector attached to the output shaft of the motor, and also with a flexible shaft and housing. The shaft is connectable between the first and second connectors, and the shaft is rotatably supported and restrained within the housing. In preferred embodiments, the servomotor is remote and not inline with respect to an axis of rotation of the throttle shaft, and is optimally separated from the throttle valve by at least one bulkhead, or firewall. A ground based conventional R/C transmitter sends control signals to a receiver operably associated with the servomotor to remotely control the servomotor, and thus the throttle, from the ground.

In a third aspect, a method for remote radio control of an aircraft throttle is presented. In this aspect, control of the aircraft throttle is substantially impervious to linkage bending effects. The method is also useful for aircraft center of gravity and balance control. The principal preferred steps of the method are, connecting an aircraft throttle shaft to a radio controlled servomotor output shaft with a flexible shaft, wherein the throttle and servo motor are remotely disposed within the aircraft with respect to each other, and directing a radio control signal from a control unit to the servomotor. Center of gravity control is effected in the method by variable disposition of the servo motor to effect a change in aircraft center of gravity. In this method the servo motor is also better protected from vibration and radio interference from the aircraft engine.

The invention is thus apparatus and method for remote rotational control of various equipment by means of a coaxially disposed flexible shaft, such as a torsion-cable, and housing or tube combination. One particular application of the invention is the remote, servo-activated rotational control of throttles for radio-controlled aircraft. In radio-controlled aircraft applications, rotational activation of the servo output shaft causes the relatively smaller twist or torsion cable, and therefore the throttle plate, to rotate and thereby to adjust the flow of fuel and air mixture through the carburetor and into the engine. It also provides a method and apparatus for the flexible, coaxial, rotational, servo actuated shaft control of aircraft throttles allowing selective location of the control servo within the aircraft and accommodating use of intermediate firewalls or other structure, all with appurtenant consequences for aircraft center of gravity control/control mechanism protection as disclosed herein.

Use of the flexible shaft and housing as a control linkage gives the control connection a number of important advantages, including the abilities to (1) control a throttle or other piece of equipment at a distance remote from the location of the servo or other actuator, without the range of motion losses or similar problems associated with conventional throttle linkages; to (2) allow remote control of throttles or other equipment without the requirement of careful alignment of the servo or other actuator and/or other conventional rod and crank linkages with the throttle or other control, thereby increasing design possibilities and permitting the rapid disconnection and/or replacement of the various components of the controlled system; and to (3) control throttles or other equipment by means of servos or other rotational actuators stored or otherwise located in remote, even sealed, areas or compartments separate from the areas or compartments containing the throttle or other equipment. Aside from the radio-controlled aircraft applications already mentioned, it is envisioned that rotational linkages may be advantageously employed on lawn mowers and the like.

BEST MODE OF CARRYING OUT THE INVENTION

Figure 1:
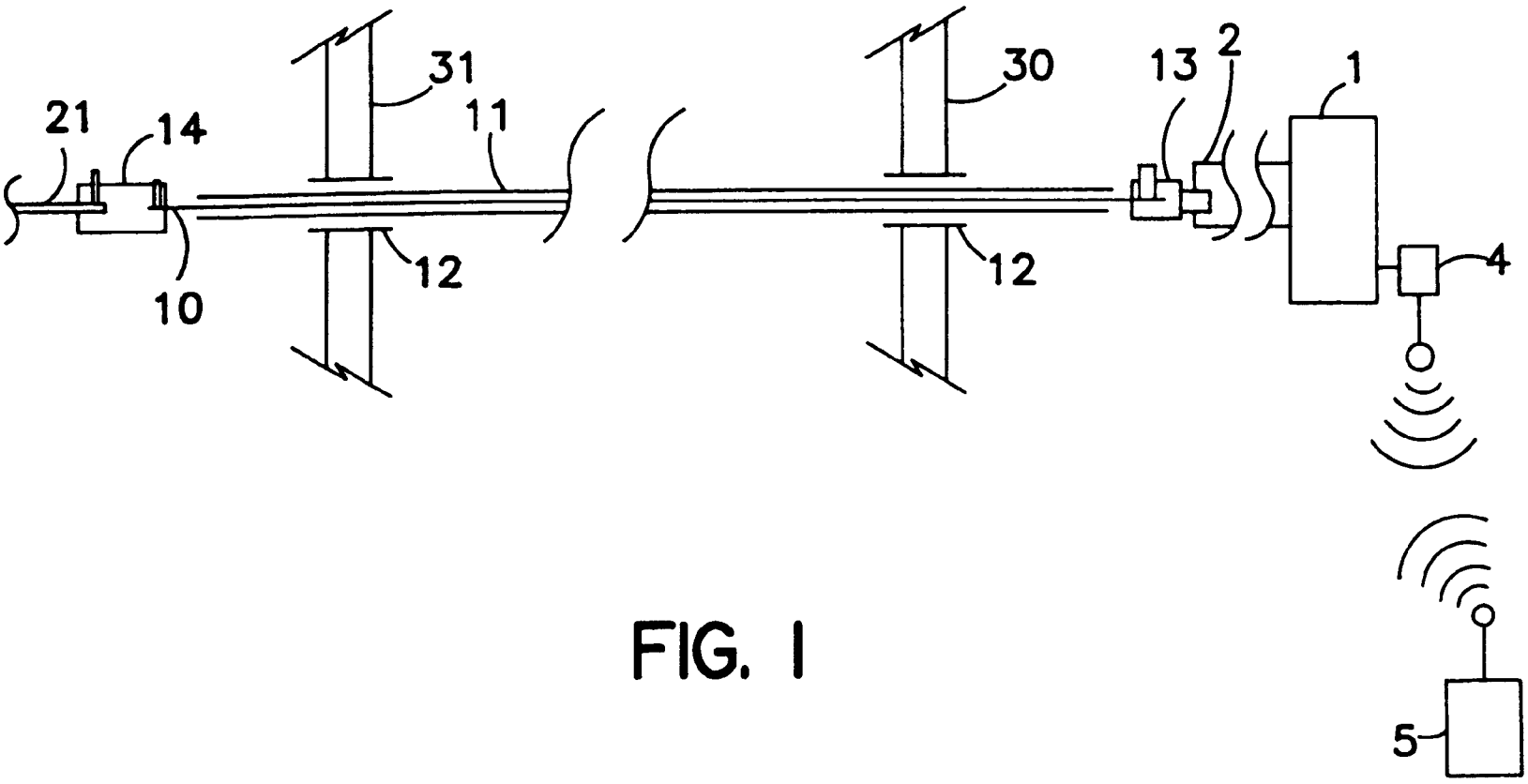
FIG. 1 is a schematic and partial sectional view of a preferred embodiment of the invention.

Turning now to the drawings, the invention will be described in a preferred embodiment by reference to the numerals of the drawing figures wherein like numbers indicate like parts.

Figure 4:
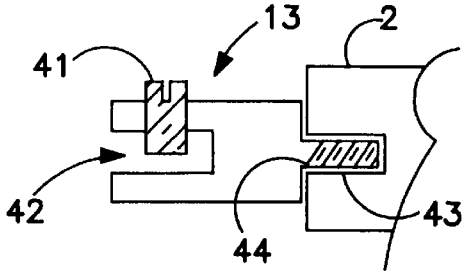
FIG. 4 is a sectional view of an aspect of the invention.

FIG. 1 is a diagrammatic schematic view of a general embodiment of the invention. Ground R/C transmitter 5 sends control signals to receiver 4 which is operably connected to servo 1. Output shaft 2 of servo 1 is connected to flexible shaft 10 by collet 13. Collet 13 is machined from a good grade of brass to have a threaded shaft 44 (see FIG. 4) which screws into specially threaded bore 43 machined or drilled into the end of output shaft 2. Collet 13 also has a bore 42 to receive shaft 10 and a set screw 41 to hold shaft 10 in bore 42. Flexible shaft 10 is preferably a stranded wire cable of the wire wrapped variety, having good to excellent torsional strain resistance, and medium to high flexibility, and brass is also preferred. All set screws and threaded shaft 44 are fixed with adhesive in their respective mounted positions. Loctite® brand thread adhesive is preferred.

Flexible shaft or cable 10 is supported and restrained from excessive flexure and from lateral movement within housing 11. Housing 11 is preferably a length of Teflon® brand tubing, where the low friction housing facilitates easy turning of shaft 10 within the housing. Housing 11 and shaft 10 pass through bulkhead 30 (optional) and firewall 31 on the way to the control member (not shown). The control member can be an aircraft engine carburetor throttle plate shaft, or the like, or any other control member requiring rotary input. Optionally, housing 11 is further supported and protected as it passes through bulkhead 30 or firewall 31 by running within rigid tubing 12. Tubing 12 is preferably a common grade of aluminum tubing.

The other end of shaft 10 then is held by set screw 41 in collet 14 (see FIG. 5), a similarly machined part to collet 13, except that it is not threaded, but rather accepts within bore 45 shaft 20 (with slight flat 47) of throttle 25 or the like, which is then held by a loctited set screw 46. Housing 11 and cable 10 are free to run wherever function dictates in the set up of the machinery being controlled; they do not have any requirement of being straight or "in line".

Figure 2:
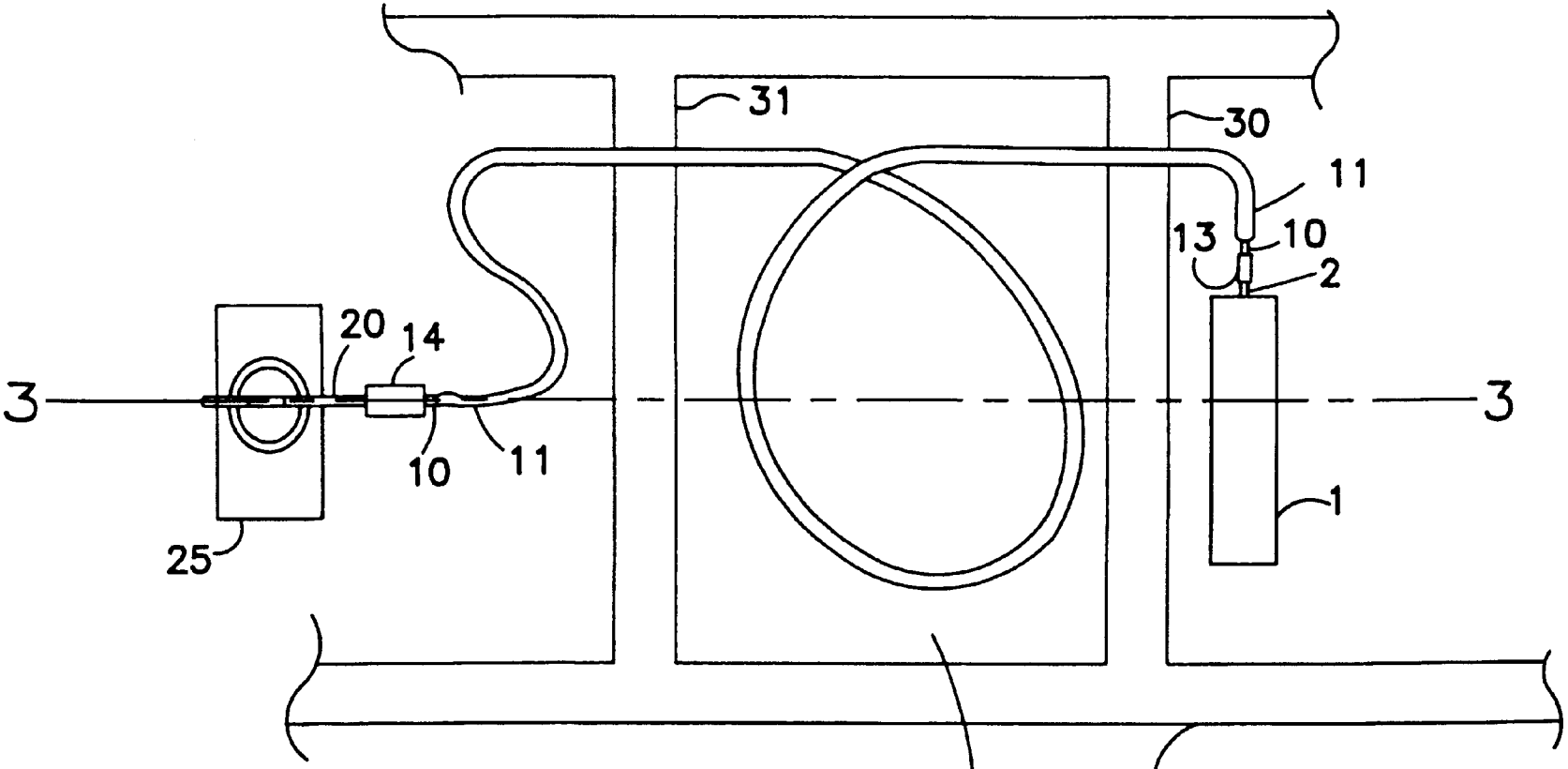
FIG. 2 is an alternate schematic of the invention.

Particular use of the invention for the remote servo control of an aircraft throttle is illustrated in FIG. 2. Servo 1 is conventionally mounted in a compartment of an aircraft fuselage 33, with servo output shaft 2, in preferred embodiments, free to be oriented in any direction relative to axis 3 of throttle plate shaft 20. For example it may actually be normal to axis 3. Relatively smaller diameter flexible shaft 10 is connected to servo output shaft 2 and to throttle plate shaft 20 of (schematically illustrated) throttle 25 by connectors 13 and 14 respectively, which in preferred embodiments are specially milled threaded collets. Relatively larger diameter flexible housing 11 is disposed about, and for most of its length preferably completely encompasses, flexible shaft 10. Housing 11 may be attached to, or alternatively pass through, bulkhead 30 and firewall 31 intervening between servo 1 and throttle 25. The restraining action of housing 11 on shaft 10 may be increased by mounting housing 11 to fuselage 33 or other relatively rigid structure at any of the various intervening points.

Flexible shaft 10 and housing 11 are preferably sized so as to allow shaft 10 to be rotatably supported inside housing 11, even when shaft 10 is disposed in something other than a straight line, or even in a complete loop. For example, it may be seen in FIG. 2 that shaft 10 and housing 11 loop completely in compartment 32 intervening between bulkhead 30 and firewall 31 without interfering with the performance of the control function of the flexible shaft.

Figure 3:
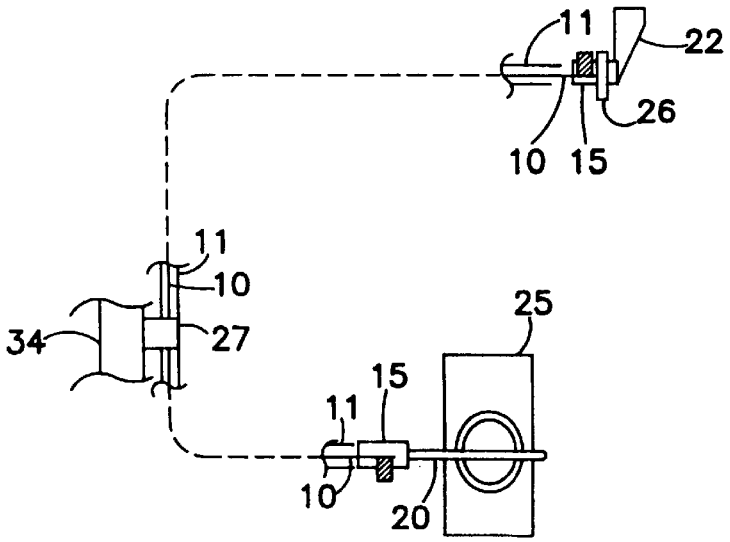
FIG. 3 is an alternate schematic of the invention.

In FIG. 3 an alternate embodiment is illustrated. The invention does not always require a motor or servo to provide the rotary input to shaft 10. It can advantageously be provided by lever 22 turning connector 15 which is attached to shaft 10 and rotatably mounted in bracket 26 which is attached to frame 34 (not shown) of the controlled machinery. Shaft 10 and housing 11 pass along frame 34 through guide 27 which can alternatively be a bracket or U clamp. Shaft 10 then terminates in a second connector 15 which (as illustrated) is attached to shaft 20 of throttle 25. This schematic is particularly well adapted to use on a lawn mower, with frame 34 being the push handle of the mower.

Figure 5:
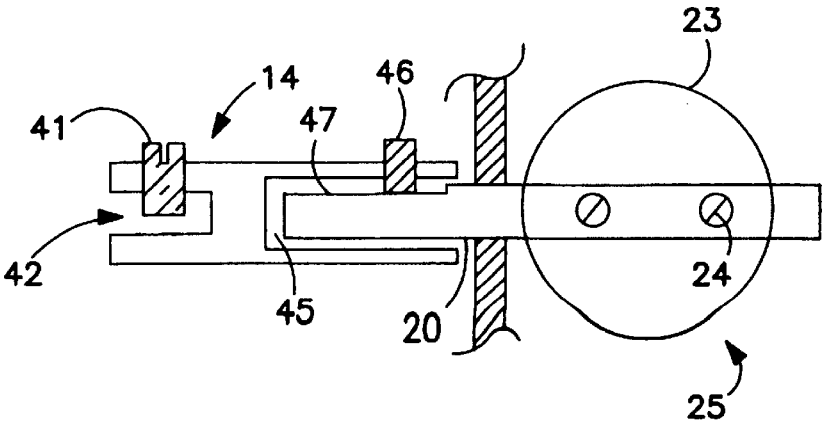
FIG. 5 is a sectional view of another aspect of the invention.

The invention also presents specially modified servo 1 (FIG. 4) and throttle 25 (FIG. 5). Servo 1 and throttle 25 are modified as shown and described above to specially interact with a rotary flexible shaft control linkage, and as such are believed to be unique.

The invention may readily be installed into a conventional R/C aircraft for throttle control in the following manner. The throttle horn is first removed from the throttle shaft. A rotary stone cutting wheel on a motorized rotary tool like a Dremel® has been found to work well. Then a flat is filed on the shaft as a seat for the set screw in collet 13. In the fuselage, appropriate holes are drilled in firewall and optionally in another bulkhead for locating servo 1, and for passage of housing 11 therethrough. The threaded end of collet 13 is joined to the threaded opening on the end of servo output shaft 2 and held in place with Loctite. Optional aluminum tubing pieces 12 are run through firewall and bulkhead openings just drilled, with the tubes pointing generally toward the carburetor and servo, respectively. Housing 11 is then run through tubes 12 to run to just before (preferably about one inch) the carburetor and just before the servo. Any excess is removed. Flexible shaft 10 is then inserted into housing 11 from the carburetor end, and engaged within the servo collet and set screwed and loctited. The cable should not be able to turn in the collet. Excess cable 10 is then cut off at the carburetor so that it bottoms out in the throttle shaft collet exactly. This set screw is not tightened at this time.

Then at the R/C transmitter, the servo is centered with the radio throttle control lever on the transmitter. Throttle travel trims at the transmitter are adjusted electronically to about 50% high and low. The radio throttle lever is then set to the middle of its throw. At the carburetor, the throttle shaft and throttle plate are manually set to about 50% open, and the set screw on this end is then tightened and loctited. This part of the procedure may readily and quickly be repeated whenever the linkage is reconnected, as in engine reinstallation.

Once again at the transmitter, high and low throttle settings are adjusted to full throw. At the carburetor, the idle screw is backed off entirely, and the low setting on the throttle is adjusted so the throttle is completely closed. There should be no apparent flexing or pre load at the top or bottom of the throttle range when it is adjusted properly as instructed herein. The aluminum tube 12 and housing 11 may now be optionally secured, such as by brackets or gluing, to the fuselage or bulkhead(s).

With regard to systems and components above referred to, but not otherwise specified or described in detail herein, the workings and specifications of such systems and components and the manner in which they may be made or assembled or used, both cooperatively with each other and with the other elements of the invention described herein to effect the purposes herein disclosed, are all believed to be well within the knowledge of those skilled in the art. No concerted attempt to repeat here what is generally known to the artisan has therefore been made.

In compliance with the statute, the invention has been described in language more or less specific as to structural features. It is to be understood, however, that the invention is not limited to the specific features shown, since the means and construction shown comprise preferred forms of putting the invention into effect. The invention is, therefore, claimed in any of its forms or modifications within the legitimate and valid scope of the appended claims, appropriately interpreted in accordance with the doctrine of equivalents.

I claim:

1. A radio controlled aircraft throttle comprising: an aircraft throttle valve modified to further comprise a first shaft connector attached to a throttle shaft of the valve, a radio controlled servomotor modified to further comprise a second shaft connector attached to an output shaft of the motor, and a flexible shaft and housing, the shaft connectable between the first and second connectors for co-rotation of motor output shaft, flexible shaft and throttle shaft, the shaft rotatably mounted within the housing.

2. The radio controlled aircraft throttle of claim 1 wherein the servomotor is remote and not inline with respect to any axis of rotation of the throttle shaft.

3. The radio controlled aircraft throttle of claim 1 wherein servo and throttle are separated by at least one bulkhead.

4. A method for remote radio control of an aircraft throttle and for aircraft center of gravity and balance control, the method comprising:

a. co-rotatably connecting an aircraft throttle shaft to a radio controlled servo motor output shaft with a flexible shaft, wherein the throttle and servo motor are remotely disposed within the aircraft with respect to each other;

b. directing a radio control signal from a control unit to the servo motor; whereby center of gravity control is effected by variable disposition of the servo motor to effect a change in aircraft center of gravity, and whereby the servo motor is somewhat protected from vibration and radio interference from the aircraft engine.

* * * * *